US010830088B2

(12) United States Patent
Ramb et al.

(10) Patent No.: US 10,830,088 B2
(45) Date of Patent: Nov. 10, 2020

(54) TURBINE HAVING A MULTIPART TURBINE HOUSING

(71) Applicant: BorgWarner Inc., Auburn Hills, MI (US)

(72) Inventors: Thomas Ramb, Worms (DE); Leif Heidingsfelder, Ramstein (DE); Christian Haibt, Alsbach-Haehnlein (DE); Frank Scherrer, Frankenthal (DE)

(73) Assignee: BorgWarner Inc., Auburn Hills, MI (US)

( * ) Notice: Subject to any disclaimer, the term of this patent is extended or adjusted under 35 U.S.C. 154(b) by 12 days.

(21) Appl. No.: 16/346,622

(22) PCT Filed: Oct. 31, 2017

(86) PCT No.: PCT/US2017/059156
§ 371 (c)(1),
(2) Date: May 1, 2019

(87) PCT Pub. No.: WO2018/085213
PCT Pub. Date: May 11, 2018

(65) Prior Publication Data

US 2019/0284951 A1 Sep. 19, 2019

(30) Foreign Application Priority Data

Nov. 2, 2016 (DE) ..... 10 2016 120 897

(51) Int. Cl.
*F01D 17/16* (2006.01)
*F01D 25/24* (2006.01)

(52) U.S. Cl.
CPC ..... *F01D 17/165* (2013.01); *F01D 25/24* (2013.01); *F05D 2220/40* (2013.01); *F05D 2240/12* (2013.01); *F05D 2240/14* (2013.01)

(58) Field of Classification Search
None
See application file for complete search history.

(56) References Cited

U.S. PATENT DOCUMENTS 4,770,603 A * 9/1988 Engels ..... F01D 5/141 415/147
7,396,204 B2 * 7/2008 Shiraishi ..... F01D 17/165 29/889.2

(Continued)

FOREIGN PATENT DOCUMENTS

DE 102008062555 A1 6/2010
EP 1816317 A2 8/2007

(Continued)

OTHER PUBLICATIONS

Written Opinion and International Search Report dated Feb. 7, 2018, in International Application No. PCT/US2017/059156.

*Primary Examiner* — Michael Lebentritt
(74) *Attorney, Agent, or Firm* — Eric L. Doyle; Stephan A. Pendorf; Patent Central LLC

(57) ABSTRACT

A turbine having variable turbine geometry for use in a combustion engine. The turbine includes a bearing housing, a turbine housing and a cartridge, which features a vane bearing ring for supporting a plurality of adjustable vanes. The turbine further includes at least one of a separator disc and a shield ring arranged radially outward of the vane bearing ring.

16 Claims, 2 Drawing Sheets

(56) References Cited

U.S. PATENT DOCUMENTS

| | | | | |
|---|---|---|---|---|
| 2004/0081567 | A1* | 4/2004 | Boening | F01D 17/165 417/406 |
| 2006/0127244 | A1* | 6/2006 | Frankenstein | F01D 17/16 417/407 |
| 2011/0014033 | A1* | 1/2011 | Boning | F01D 17/165 415/148 |
| 2011/0014034 | A1* | 1/2011 | Blummel | F01D 17/165 415/151 |
| 2011/0038742 | A1* | 2/2011 | Fleig | F01D 25/246 417/406 |
| 2011/0286838 | A1* | 11/2011 | Boening | F02C 6/12 415/170.1 |
| 2014/0212277 | A1* | 7/2014 | Uesugi | F01D 17/145 415/151 |
| 2016/0169094 | A1* | 6/2016 | Howell | F02B 37/24 60/605.1 |
| 2017/0082018 | A1* | 3/2017 | Bayod | F01D 25/24 |
| 2017/0122124 | A1* | 5/2017 | Ramb | F01D 9/041 |
| 2018/0266268 | A1* | 9/2018 | Karstadt | F01D 9/026 |

FOREIGN PATENT DOCUMENTS

| | | | |
|---|---|---|---|
| EP | 2573363 | A2 | 3/2013 |
| WO | 03087558 | A1 | 10/2003 |
| WO | 2007111759 | A2 | 10/2007 |

* cited by examiner

TURBINE HAVING A MULTIPART TURBINE HOUSING

FIELD OF THE INVENTION

The present invention relates to a turbine having a multipart turbine housing and a turbocharger having a turbine of this kind.

BACKGROUND OF THE INVENTION

An increasing number of the latest generation of vehicles are being equipped with turbocharging devices. In order to fulfill design goals and the legal requirements, it is important to develop advances optimizing the reliability and efficiency of the entire powertrain and its individual components as well as the system as a whole.

Exhaust gas turbocharges are known, for example, in which the exhaust gas flow from a combustion engine drives a turbine having a turbine wheel. A compressor wheel, which is arranged on a common shaft together with the turbine wheel, compresses the fresh intake air for the engine. Doing so increases the quantity of air, or rather oxygen, available to the engine, thus causing an increase in the performance of the combustion engine.

Turbines of this kind can also be used when decoupled from the exhaust turbocharger or, for example, in combination with an air supply for a fuel cell engine.

Since the turbines are driven by the flow of exhaust gas, very high temperatures occur in the area of the turbine wheel and the turbine housing. Since the turbine housing is coupled with a bearing housing, which serves to support the shaft upon which the turbine wheel is mounted, these high temperatures are also transferred to the bearing housing. Excessive temperatures in the bearing housing can have a negative impact on efficiency and wear resistance.

Accordingly, the present invention aims to provide a turbine exhibiting improved temperature management, particularly in the flange section between the turbine housing and an adjacent bearing housing.

SUMMARY OF THE INVENTION

The present invention relates to a turbine having variable turbine geometry according to claim 1 and a turbocharger according to claim 15.

The turbine according to the invention having variable turbine geometry for use in a combustion engine comprises a bearing housing, a turbine housing and a cartridge, which features a vane bearing ring for supporting a plurality of adjustable vanes. The turbine further comprises a separator disc and/or a shield ring, whereby the separator disc and/or the shield ring are arranged radially outward of the vane bearing ring. The separator disc and/or the shield ring have a beneficial impact on the temperature management in the connecting area or flange section between the turbine housing and the bearing housing. In particular, the temperature stress on the bearing housing is reduced.

In embodiments, the separator disc and/or the shield ring can be clamped between the turbine housing and the bearing housing.

In embodiments able to be combined with all of the embodiments described thus far, the shield ring can adjoin the bearing housing and be arranged in an axial direction between the bearing housing and the turbine housing, or be arranged between the bearing housing and a radially outer portion of the separator disc, said portion being arranged between the shield ring and the turbine housing.

In embodiments able to be combined with all of the embodiments described thus far, a radially outer portion of the separator disc can adjoin the turbine housing and be arranged in an axial direction between the shield ring and the turbine housing, or between the turbine housing and the bearing housing.

In embodiments able to be combined with all of the embodiments described thus far, a first ledge on an interior surface of the turbine housing can fix the position of the separator disc and/or the shield ring.

In embodiments able to be combined with all of the embodiments described thus far, a seal can be arranged radially outward of the shield ring between the shield ring and the turbine housing. The seal can in particular comprise a V-ring seal. The seal can be arranged in axial direction between a second ledge on the interior surface of the turbine housing and a radial side surface of the bearing housing. The seal can furthermore be arranged in a radial direction between an exterior surface of the shield ring and an interior surface of the turbine housing.

In embodiments able to be combined with all of the embodiments described thus far, a passage can be formed in a radial direction between the vane bearing ring and the separator disc. The passage can in particular extend along the entire circumference of the vane bearing ring.

In embodiments able to be combined with all of the embodiments described thus far, the separator disc and/or the shield ring can be arranged to be concentric to a rotational axis of the turbine.

In embodiments able to be combined with all of the embodiments described thus far, a first side surface of the separator disc can be arranged to be flush with a front side of the vane bearing ring facing the vanes.

In embodiments able to be combined with all of the embodiments described thus far, the separator disc can border a spiral in the turbine housing in an axial direction.

In embodiments able to be combined with all of the embodiments described thus far, the shield ring can be designed in the shape of a hollow cylinder and extend in an axial direction. At least a predominant portion of the shield ring can be arranged at a distance from the turbine housing so that a gap exists in a radial direction between the shield ring and the turbine housing along at least the majority of the axial extent of the shield ring. This is advantageous because the radial gap between the shield ring and the turbine housing as well as a flange section of the turbine housing and the bearing housing protects the shielding from high temperatures.

In embodiments able to be combined with all of the embodiments described thus far, the separator disc and the shield ring can be designed as a one-piece, integral component.

In embodiments able to be combined with all of the embodiments described thus far, on an axially extending interior surface of the turbine housing, an outer wall of the turbine housing bordering the spiral volume of the turbine housing in a radial direction exhibits no undercut from the spiral to an axial end of the outer wall in the direction of the bearing housing. Using this design can greatly simplify the casting of the turbine housing since the sand used can be quite safely and easily removed.

The invention furthermore comprises a turbocharger having a turbine according to any of the previously described embodiments.

Additional details and features of the invention are described in reference to the drawings as follows.

DETAILED DESCRIPTION

Embodiments of the turbine according to the invention will be described in reference to the drawings as follows.

Figure 1A:
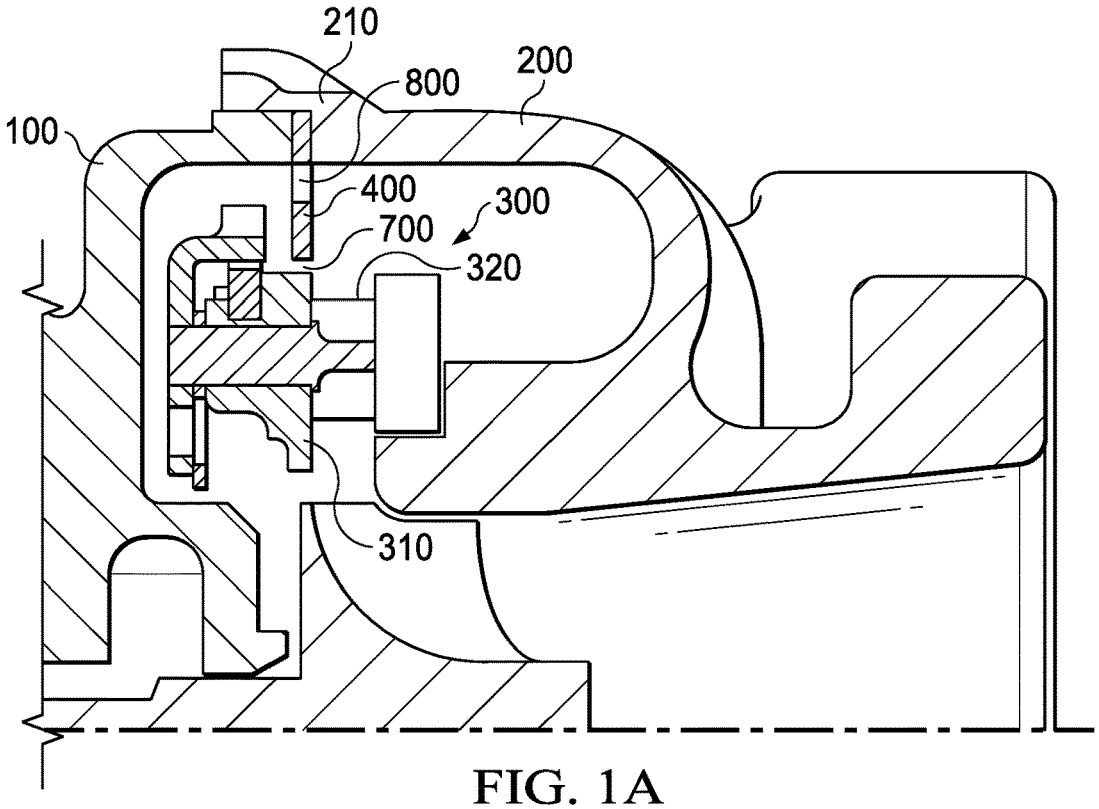
FIG. 1A is a section view through a first embodiment of the turbine according to the invention.
Figure 1B:
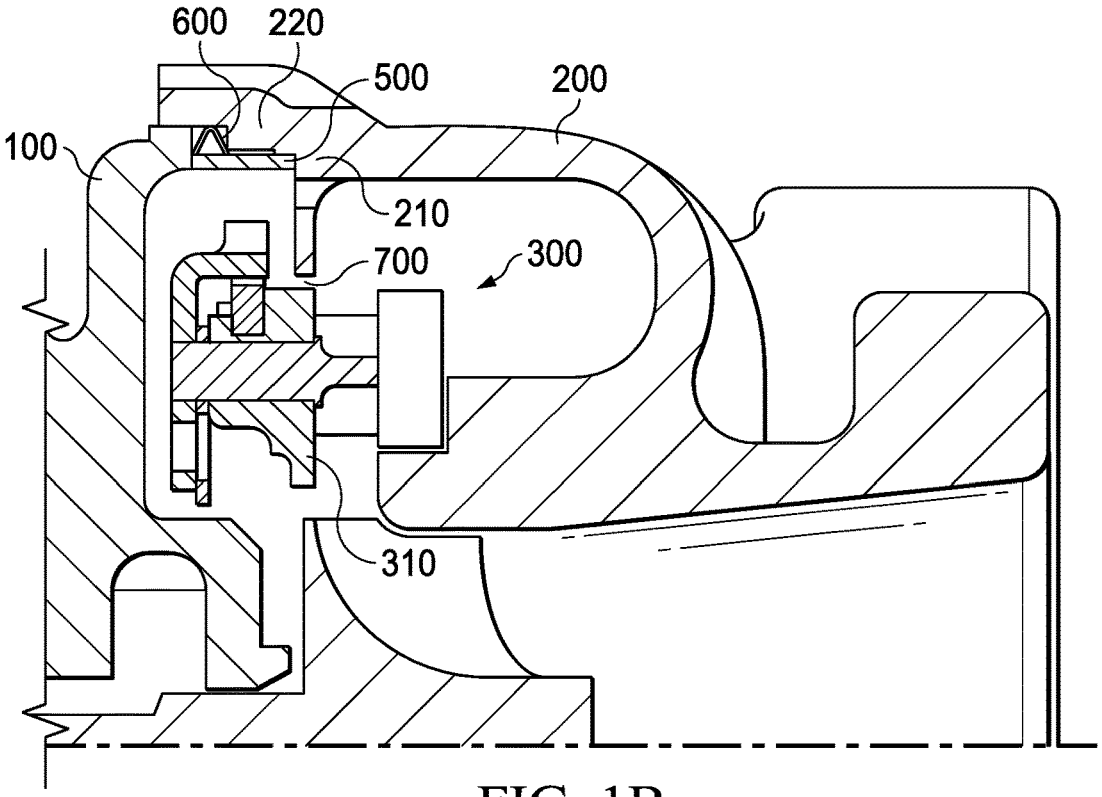
FIG. 1B is a section view through a second embodiment of the turbine according to the invention.

It is true of all of the embodiments illustrated in the drawings that the turbine features a turbine housing 200 adjoining a bearing housing 100. The turbine further comprises a variable turbine geometry cartridge 300. The cartridge has a vane bearing ring 310 for supporting a plurality of adjustable vanes 320. These features can be seen, for example, in FIG. 1A, FIG. 1B and FIG. 2. The embodiment shown in FIG. 1A further features a separator disc 400, which is arranged radially outward of the vane bearing ring 310. The separator disc 400 is thus clamped between the turbine housing 200 and the bearing housing 100 and borders a spiral of the turbine housing 300 in an axial direction. In the alternative embodiments in FIG. 1B, the turbine comprises a shield ring 500, which is arranged radially outward of the vane bearing ring 310 and is clamped between the bearing housing 100 and the turbine housing 200. In the special embodiment shown in FIG. 1B, the turbine housing 200 features a projection 210, which projects far inward in a radial direction and borders the spiral axially in the direction of the bearing housing 100. In the further embodiments in FIGS. 2, 2A and 2B, the shield ring 500 and the separator disc 400 are provided in combination. The shield ring 500 and the separator disc 400 may thus be provided as two separate components (see FIGS. 2 and 2A) or as an integrated component (see FIG. 2B). As is clearly apparent from all of the drawings, the separator disc 400 and the shield ring 500 are thus always separate, individual components or an integral component separate from the bearing housing and the turbine housing. As shown in FIG. 1A and FIG. 1B, the separator disc or the shield ring (or combination of the two, see FIGS. 2 to 2B) are thus enclosed radially outward by the turbine housing and are supported by a first ledge 210 located radially inward. In addition, the separator disc 400 and/or the shield ring 500 are arranged to be concentric to a rotational axis of the turbine.

The separator disc 400 and/or the shield ring 500 have a beneficial impact on the temperature management in the connecting area or flange section between the turbine housing 200 and the bearing housing 100. In particular, the temperature stress on the bearing housing 100 is reduced.

As is apparent from FIG. 1A, for example, the separator disc 400 defines a side wall of the spiral, thus serving to (partially) separate the spiral area of the turbine, in which gases are flowing, from the area in which the adjustment mechanism for the variable turbine geometry cartridge 300 is arranged. Since certain portions of the separator disc 400 prevent direct contact between the turbine housing 200 and the bearing housing 100, the heat transfer from the turbine housing 200 to the bearing housing 100 will be reduced in these portions, thus reducing the thermal stress on the bearing housing 100. In the known housings, this separation is accomplished by a kind of crosspiece projecting from an interior wall of the turbine housing. Given that they are exposed to relatively high stresses, crosspieces of this kind are susceptible to cracking. The susceptibility of the crosspiece to cracking can be eliminated by replacing it with the separator disc 400. The separator disc 400 can, for example, be made of a heat-resistant material, as a result further reducing the effects of high turbine temperatures on the adjacent components, for example the bearing housing 100.

Furthermore, the turbine housing 200 can by virtue of the separator disc 400 be of a (completely) open design. This offers advantages for the casting process used to manufacturer the turbine housing 200, for example enabling the core and/or the sand to be easily removed. In addition, use of the open turbine housing 200 simplifies the machining of the turbine housing 200 and improves the initial introduction of the turbine housing. The overall durability of the turbine can be enhanced due to these advantages as well as to the improved and more variable position of the separator disc 400 in the turbine housing 200.

Figure 2:
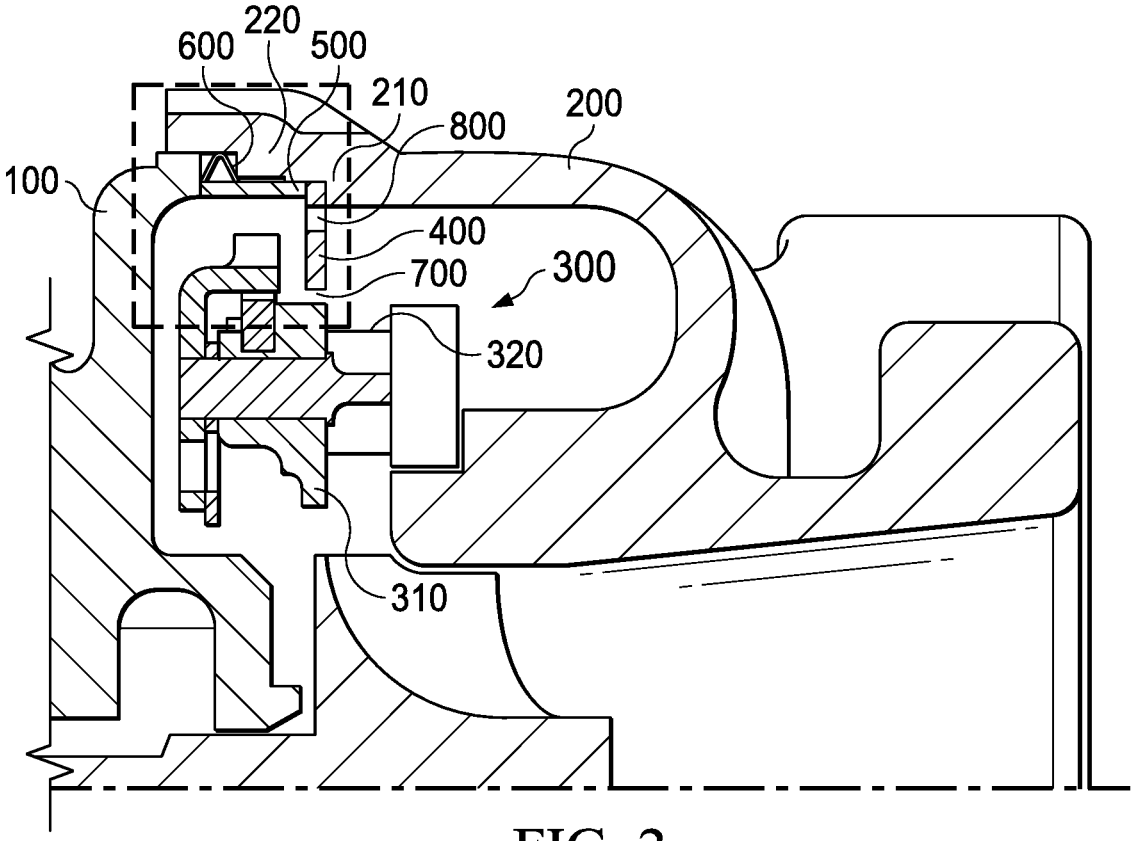
FIG. 2 is a section view through a third embodiment of the turbine according to the invention.

FIG. 1B and FIG. 2 show embodiments having a shield ring 500, which can likewise be manufactured from a heat-resistant material. The shield ring 500 borders a radially outward portion of the turbine housing 200 in which the variable turbine geometry adjustment mechanism is arranged. The shield ring 500 both absorbs the axial force between the bearing housing 100 and the turbine housing 200 and reduces the area of contact between the bearing housing 100 and the turbine housing 200. Another result is a reduction of the thermal stress on the bearing housing 100 caused by the turbine housing 200. In addition, the shield ring 500 shields a flange section of the turbine housing 200 and the bearing housing 100 from high temperatures. Furthermore, a seal 600 (for example) can be provided in the area of the shield ring 500 (see, for example, FIGS. 1B, 2, 2A and 2B) to protect the connecting area between the bearing housing 100 and the turbine housing 200 from excessive temperatures and from particles such as dirt, soot, or the like.

Figure 2A:
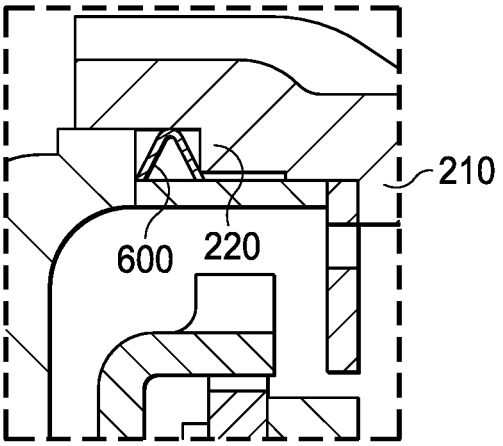
FIGS. 2A and 2B are detail views of further embodiments of the turbine according to the invention.

As mentioned earlier, it is possible to use the separator disc 400 in combination with the shield ring 500 in a simple manner. In doing so, the combination of the separator disc 400 and the shield ring 500 can be realized as an integral component (FIG. 2B) as well as a two-piece component (FIGS. 2, 2A).

As can be seen in FIG. 1B, for example, the shield ring 500 adjoins the bearing housing 100 and is arranged in an axial direction between the bearing housing 100 and the turbine housing 200. In the alternative embodiments in FIG. 2*a*, the shield ring 500 is arranged between the bearing housing 100 and a radially outer portion of the separator disc 400, which is in turn arranged between the shield ring 500 and the turbine housing 200.

A radially outer portion of the separator disc 400 adjoins the turbine housing 200 and is arranged in an axial direction between the shield ring 500 and the turbine housing 200 (see FIG. 2), or between the turbine housing 200 and the bearing housing 100 (see FIG. 1A).

As can be seen in all of the drawings, a first ledge 210 on an interior surface of the turbine housing 200 can fix the position of the separator disc 400 and/or the shield ring 500. Depending on whether the design has only a separator disc 400 (see FIG. 1A) or only a shield ring 500 (see FIG. 1B), the separator disc 400 or the shield ring 500 is clamped between the turbine housing 200 and the bearing housing 100. If only a separator disc 400 is present, then a radially outer portion of the separator disc 400 is clamped between the bearing housing 100 and the turbine housing 200, in particular in the portion of the ledge 210 provided for this purpose in the turbine housing 200 (see FIG. 1A). If only one shield ring 500 is provided, then a first end of the shield ring 500 is situated (in relation to the longitudinal extent of the shield ring 500 in the direction of the turbine rotational axis) on the bearing housing 100, and a second end is situated on the turbine housing 200, in particular on the projection 210 or on a step-shaped formation on the inner circumference of the turbine housing 200, which simultaneously serves for centering the shield ring 500.

In the event that a separator disc 400 and a shield ring 500 are provided (see FIGS. 2, 2A and 2B), if the separator disc 400 and the shield ring 500 are provided as two separate components (as shown in FIG. 2 and detailed in FIG. 2A), a radially outer portion of the separator disc 400 is clamped between the shield ring 500 and the turbine housing 200, and the shield ring 500 is clamped between the separator disc 400 and the bearing housing 100, whereby the first end of the shield ring 500 is in contact with the bearing housing 100, and the second end of the shield ring 500 is in contact with the separator disc 400. Consequently, the separator disc 400 and the shield ring 500 are in this case arranged as a combination between the bearing housing 100 and the turbine housing 200. If the separator disc 400 and the shield ring 500 are provided as a one-piece, integral component (see FIG. 2B), then this component is clamped between the turbine housing 200 and the bearing housing 100.

Figure 2B:
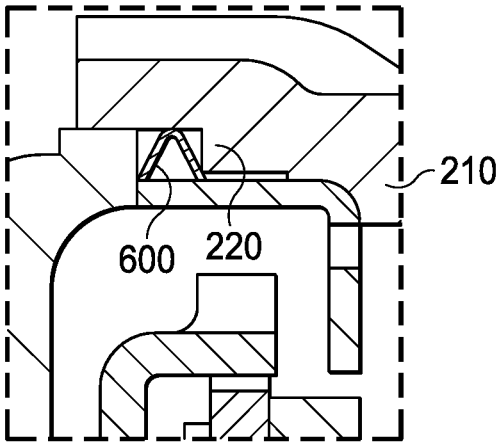

In the embodiments in FIGS. 1B and 2 to 2B, the aforementioned seal 600 is arranged radially outward of the shield ring 400, between the shield ring 500 and the turbine housing 200. In particular, the seal 600 can, for example, comprise a V-ring seal. The seal 600 is arranged in axial direction between a second ledge 220 on the interior surface of the turbine housing 200 and a radial side surface of the bearing housing 100. It should at this juncture be clarified that, in the context of this application, radial surfaces refer to surfaces lying in planes oriented in a direction perpendicular to the rotational axis of the turbine shaft. The seal 600 is thus arranged in a radial direction between an exterior surface of the shield ring 500 and an interior surface of the turbine housing 200.

As is also illustrated in the drawings, a passage 700 is formed in a radial direction between the vane bearing ring 310 and the separator disc 400. The passage 700 extends along the entire circumference of the vane bearing ring 310 and constitutes an axial communication between the turbine spiral and the area of the turbine in which the adjustment mechanism for the cartridge 300 is arranged. In addition, it can be provided that the separator disc 400 features at least one through-hole 800 (see FIG. 1A and FIG. 2). For example, at least two through-holes 800 can be formed to be evenly spaced in a circumferential direction. In particular, the through-hole(s) 800 can be arranged in a radially outward half of the separator disc 400, preferably near an inner wall of the turbine housing 200. Advantageously, the passage 700 and/or the through-holes 800 enable a degree of throughflow of the hot gases in the area of a rear side (relative to a front side, upon which the vanes 320 are arranged) of the vane bearing ring 310. Doing so prevents the development of excessive temperature differences between the front side and the rear side of the vane bearing ring 310, which, owing to differences in the thermal expansion of the corresponding areas, may lead to stresses on and the warping of the vane bearing ring 310 and, therefore, the entire cartridge 300 as well. This advantage also allows the gap between the vane bearing ring 310 and the vanes 320 of the cartridge 300 to be narrowed without risk of the blades 320 becoming jammed.

As illustrated in FIG. 1A and FIG. 2, for example, a first side surface of the separator disc 400 can be arranged to be flush with a front side of the vane bearing ring 310 facing the vanes 320.

The shield ring 500 is designed in the shape of a hollow cylinder and extends in an axial direction. At least a predominant portion of the shield ring 500 is arranged at a distance from the turbine housing 200 so that a gap exists in a radial direction between the shield ring 500 and the turbine housing 200 along at least the majority of the axial extent of the shield ring 500 (FIG. 2A and FIG. 2B). This is advantageous because the radial gap between the shield ring 500 and the turbine housing 200 as well as a flange section of the turbine housing 200 and the bearing housing 100 protects the shielding from high temperatures. As a result, less heat will be transferred from the turbine housing 200 to the bearing housing 100.

As previously mentioned, the shield ring 500 and the separator disc 400 can also be designed as a one-piece, integral component. This is illustrated in FIG. 2B. In a two-piece embodiment or if either the separator disc 400 or the shield ring 500 is provided, the separator disc 400 can, for example, be a stamped piece, and the shield ring can, for example, be a stamped and bent piece. In a one-piece embodiment, the combined component consisting of an integral shield ring 500 and separator disc 400 can, for example, be manufactured by means of deep drawing and stamping, or it may also be turned.

For example, in the embodiments in FIG. 1A and FIG. 2, on an axially extending interior surface of the turbine housing 200, an outer wall of the turbine housing 200 bordering the spiral volume of the turbine housing 200 in a radial direction exhibits no undercut from the spiral to an axial end of the outer wall in the direction of the bearing housing 100. Said another way, the side of the turbine housing 200 is designed to be completely open in the direction of the bearing housing 100. Using this design for the turbine housing 200 can greatly simplify the casting of the turbine housing 200 since the core or the sand used during casting can be quite safely and easily removed.

The invention further comprises a turbocharger having a turbine according to any of the previously described embodiments.

Although the present invention has been described above and is defined in the attached claims, it should be understood that the invention may alternatively be defined in accordance with the following embodiments:

1. A turbine having variable turbine geometry for use in a combustion engine comprising
   a bearing housing (100);
   a turbine housing (200); and
   a cartridge (300), which features a vane bearing ring (310) for supporting a plurality of adjustable vanes (320),
   characterized by a separator disc (400) and/or a shield ring (500), wherein the separator disc (400) and/or the shield ring (500) are arranged radially outward of the vane bearing ring (310).
2. The turbine according to embodiment 1, characterized in that the separator disc (400) and/or the shield ring (500) are clamped between the turbine housing (200) and the bearing housing (100).
3. The turbine according to embodiment 1 or embodiment 2, characterized in that the shield ring (500) adjoins the bearing housing (100) and is arranged in an axial direction between the bearing housing (100) and the turbine housing (200), or is arranged between the bearing housing (100) and a radially outer portion of the separator disc (400), said portion being arranged between the shield ring (500) and the turbine housing (200).

4. The turbine according to any of the previous embodiments, characterized in that a radially outer portion of the separator disc (400) adjoins the turbine housing (200) and is arranged in an axial direction between the shield ring (500) and the turbine housing, or between the turbine housing (200) and the bearing housing (100).

5. The turbine according to any of the previous embodiments, characterized in that a first ledge (210) on an interior surface of the turbine housing (200) fixes the position of the separator disc (400) and/or the shield ring (500).

6. The turbine according to any of the previous embodiments, characterized in that a seal (600) is arranged radially outward of the shield ring (400) between the shield ring (500) and the turbine housing (200), said seal (600) comprising in particular a V-ring seal.

7. The turbine according to embodiment 6, characterized in that the seal (600) is arranged in axial direction between a second ledge (220) on the interior surface of the turbine housing (200) and a radial side surface of the bearing housing (100).

8. The turbine according to embodiment 6 or embodiment 7, characterized in that the seal (600) is arranged in radial direction between an exterior surface of the shield ring (500) and an interior surface of the turbine housing (200).

9. The turbine according to any of the previous embodiments, characterized in that a passage (700) is formed in a radial direction between the vane bearing ring (310) and the separator disc (400), particularly wherein the passage (700) extends along the entire circumference of the vane bearing ring (310).

10. The turbine according to any of the previous embodiments, characterized in that the separator disc (400) and/or the shield ring (500) are arranged to be concentric to a rotational axis of the turbine.

11. The turbine according to any of the previous embodiments, characterized in that a first side surface of the separator disc (400) is arranged to be flush with a front side of the vane bearing ring (310) facing the vanes (320).

12. The turbine according to any of the previous embodiments, characterized in that the separator disc (400) borders a spiral of the turbine housing (300) in an axial direction.

13. The turbine according to any of the previous embodiments, characterized in that the shield ring (500) is designed in the shape of a hollow cylinder and extends in an axial direction.

14. The turbine according to embodiment 13, characterized in that at least a predominant portion of the shield ring (500) is arranged at a distance from the turbine housing (200) so that a gap exists in a radial direction between the shield ring (500) and the turbine housing (200) along at least the majority of the axial extent of the shield ring (500).

15. The turbine according to any of the previous embodiments, characterized in that the shield ring (500) and the separator disc (400) are designed as a one-piece, integral component.

16. The turbine according to any of the previous embodiments, characterized in that, on an axially extending interior surface of the turbine housing (200), an outer wall of the turbine housing (200) bordering the spiral volume of the turbine housing (200) in a radial direction exhibits no undercut from the spiral to an axial end of the outer wall in the direction of the bearing housing (100).

17. A turbocharger having a turbine according to any of the preceding embodiments.

The invention claimed is:

1. A turbine having variable turbine geometry for use in a combustion engine, comprising:

a bearing housing (100);

a turbine housing (200); and a cartridge (300), which features a vane bearing ring (310) for supporting a plurality of adjustable vanes (320), wherein at least one of a separator disc (400) and a shield ring (500) is arranged radially outward of the vane bearing ring (310).

2. The turbine according to claim 1, wherein said at least one separator disc (400) or shield ring (500) is clamped between the turbine housing (200) and the bearing housing (100).

3. The turbine according to claim 1, wherein the shield ring (500) adjoins the bearing housing (100) and is arranged in an axial direction between the bearing housing (100) and the turbine housing (200), or is arranged between the bearing housing (100) and a radially outer portion of the separator disc (400), said portion being arranged between the shield ring (500) and the turbine housing (200).

4. The turbine according to claim 1, wherein a radially outer portion of the separator disc (400) adjoins the turbine housing (200) and is arranged in an axial direction between the shield ring (500) and the turbine housing, or between the turbine housing (200) and the bearing housing (100).

5. The turbine according to claim 1, wherein a first ledge (210) on an interior surface of the turbine housing (200) fixes the position of the at least one separator disc (400) or shield ring (500).

6. The turbine according to claim 1, wherein a seal (600) is arranged radially outward of the shield ring (400) between the shield ring (500) and the turbine housing (200), said seal (600) comprising in particular a V-ring seal.

7. The turbine according to claim 6, wherein the seal (600) is arranged in axial direction between a second ledge (220) on the interior surface of the turbine housing (200) and a radial side surface of the bearing housing (100).

8. The turbine according to claim 6, wherein the seal (600) is arranged in radial direction between an exterior surface of the shield ring (500) and an interior surface of the turbine housing (200).

9. The turbine according to claim 1, wherein a passage (700) is formed in a radial direction between the vane bearing ring (310) and the separator disc (400).

10. The turbine according to claim 1, wherein a first side surface of the separator disc (400) is arranged flush with a front side of the vane bearing ring (310) facing the vanes (320).

11. The turbine according to claim 1, wherein the shield ring (500) is in the shape of a hollow cylinder and extends in an axial direction.

12. The turbine according to claim 11, wherein at least a predominant portion of the shield ring (500) is arranged at a distance from the turbine housing (200) so that a gap exists in a radial direction between the shield ring (500) and the turbine housing (200) along at least the majority of the axial extent of the shield ring (500).

13. The turbine according to claim 1, wherein the shield ring (500) and the separator disc (400) are a one-piece, integral component.

14. The turbine according to claim 1, wherein, on an axially extending interior surface of the turbine housing (200), an outer wall of the turbine housing (200) bordering the spiral volume of the turbine housing (200) in a radial direction exhibits no undercut from the spiral to an axial end of the outer wall in the direction of the bearing housing (100).

15. A turbocharger having a turbine according to claim 1.

16. The turbine according to claim 1, wherein a passage (700) is formed in a radial direction between the vane bearing ring (310) and the separator disc (400), wherein the passage (700) extends along the entire circumference of the vane bearing ring (310).

* * * * *